US008939060B2

(12) United States Patent
Bassoli et al.

(10) Patent No.: US 8,939,060 B2
(45) Date of Patent: Jan. 27, 2015

(54) FIREARM OPERATING SYSTEM

(75) Inventors: Marco Bassoli, Gardone Val Trompia (IT); Sergio Bonomi, Gardone Val Trompia (IT); Ugo Ansaldi, Gardone Val Trompia (IT)

(73) Assignee: Fabbrica D'Armi Pietro Beretta S.p.A., Gardone Val Trompia, Brescia (IT)

( * ) Notice: Subject to any disclaimer, the term of this patent is extended or adjusted under 35 U.S.C. 154(b) by 0 days.

(21) Appl. No.: 14/114,380

(22) PCT Filed: Jun. 5, 2012

(86) PCT No.: PCT/IB2012/052825

§ 371 (c)(1), (2), (4) Date: Oct. 28, 2013

(87) PCT Pub. No.: WO2012/176086

PCT Pub. Date: Dec. 27, 2012

(65) Prior Publication Data

US 2014/0096674 A1 Apr. 10, 2014

(30) Foreign Application Priority Data

Jun. 23, 2011 (IT) ..... BS2011A0093

(51) Int. Cl.
*F41A 5/02* (2006.01)
*F41A 3/26* (2006.01)

(52) U.S. Cl.
CPC .... *F41A 5/02* (2013.01); *F41A 3/26* (2013.01)
USPC ..... 89/162

(58) Field of Classification Search
USPC ..... 89/161, 162, 164–166, 160, 177, 182, 89/178, 159
See application file for complete search history.

(56) References Cited

U.S. PATENT DOCUMENTS 3,517,586 A 6/1970 Stoner
4,677,897 A 7/1987 Barrett

FOREIGN PATENT DOCUMENTS

EP 0 156 423 A1 10/1985
EP 1 950 520 A1 7/2008

*Primary Examiner* — Reginald Tillman, Jr.
(74) *Attorney, Agent, or Firm* — Meunier Carlin & Curfman, LLC

(57) ABSTRACT

An operating system for an individual firearm, such as a rifle, comprises a carriage (14) sliding axially in the compartment of the body of the firearm, an obturator (10) associable to the barrel (2), an elastic element (16), compressible between the carriage (14) and the obturator (10). In the configuration of firearm ready to fire with the bullet in the barrel, the obturator (10) has a free compression stroke (D) for the compression of the elastic element (16) and the barrel (2) has a free firing stroke (C) in relation to the abutment (32) of the operating compartment (8).

11 Claims, 8 Drawing Sheets

FIREARM OPERATING SYSTEM

BACKGROUND OF THE INVENTION

The present invention relates to an operating system for an individual firearm, such as a rifle or a gun. The term "operating system" is used to indicate in the field of the specific art, the entirety of mechanisms enabling, once a cartridge has been fired, the expulsion of the case of the fired cartridge and the loading of a new cartridge.

In particular, the invention relates to the semiautomatic individual firearm sector, for which the expulsion of the case of the fired cartridge and the loading of a new cartridge occur automatically as a consequence of firing the previous cartridge.

The invention also relates to the automatic individual firearm sector, for which firing is also automatically activated.

DESCRIPTION OF THE PRIOR ART

Numerous semi-automatic operating systems exist.

"Gas Intake" Operating System

A first type of semi-automatic operating system is called "gas intake" in that it uses the energy of the gases deriving from the explosion of the powder of a cartridge. A small quantity of such gases is extracted from the barrel and, opportunely exploited, enables the cycle of opening and expelling the case and rearming.

One embodiment example of the gas intake operating system is described in the European patent EP-B1-1162427 in the Applicant's name, in which use is made of a partialising valve to limit the effects of overly violent gas explosions caused by the use of heavy cartridges.

One of the drawbacks of gas intake operating systems is the need for complicated maintenance of the system, above all on account of the non-combusted gases which soil and form a deposit on the moving mechanical parts.

"Inertial" Operating System

A further type of semi-automatic operating system is known as "inertial", in that it exploits the recoil of the entire firearm deriving from firing.

In particular, the mechanism envisages a sliding obturator carriage, an obturator of the cartridge chamber and a spring positioned between the carriage and the obturator.

On firing, the firearm recoils; the carriage, by inertia, remains in a fixed position in relation to the obturator, which instead moves backwards inasmuch as joined to the barrel; the spring is thereby compressed. The subsequent relaxation of the spring pushes the carriage backwards, enables the cycle of opening and expelling the case and rearming to be activated.

One embodiment example is described in the document U.S. Pat. No. 3,447,417.

Such a system is most advantageous: is simple and economical to achieve and does not require careful maintenance. However, it is a system the performance of which depends heavily on the firearm recoil.

Consequently, for the system to function correctly a lightweight rifle is needed; in addition, the system is sensitive to the user's reaction to firing (in the jargon, sensitive to the user's "shoulder", with which the butt of the rifle abuts; if the shoulder is tense, the rifle does not recoil and the system may not rearm); lastly, the system could also fail to operate correctly in the case of lightweight cartridges which do not cause a forceful recoil.

"Short Barrel Recoil" System

A further type of semi-automatic operating system is called "short barrel recoil", in that it exploits the recoil of the barrel only, which after a short stroke, stops against the body.

In such system, the barrel slides in relation to the body of the firearm and, following the explosion of the powder in the cartridge chamber, recoils, pushing the obturator and the obturator carriage backwards.

After a short stroke, the barrel stops against the body and ends its backward stroke, while the obturator carriage continues its stroke, activating the opening and expulsion cycle and the rearming cycle.

The system is generally scaled on the basis of the smallest cartridges which are to be fired; for heavy cartridges, the recoil speed of the barrel is very high, but is limited by the fact that the recoil stroke is short. A damper system must be envisaged in any case between the barrel and the body.

One embodiment example is described in the European patent application EP 1950520 in the Applicant's name.

One embodiment example also exists wherein a portion of the barrel, that is the cartridge camber, moves towards the recoil movement; such solution is described in the documents U.S. Pat. No. 2,476,232 and U.S. Pat. No. 2,847,787.

The short barrel recoil system does not require complicated maintenance, nor is it heavily influenced by user characteristics and it is a simple and economical system.

However, such system presents some drawbacks for firing heavy cartridges on account of the impact between the barrel and the body, needing in any case a damper system between the barrel and the body.

"Long Barrel Recoil" System

A further type of semi-automatic operating system is called "long barrel recoil", in that it exploits the recoil of the barrel only, which moves backwards for a stroke at least as long as the cartridge chamber, before stopping against the body.

In such system, the barrel slides in relation to the body of the firearm and, following the explosion of the powder in the cartridge chamber, recoils, pushing the obturator and the obturator carriage backwards.

After a long stroke, the barrel stops against the body and ends its backward stroke, while the obturator carriage continues its stroke, activating the opening and expulsion cycle of the cartridge case; the carriage is retained in a rearward position. At this point, the barrel moves forward again, to perform the rearming cycle. At the end of rearming, the carriage is released and returns forward, performing the closing cycle.

The long barrel recoil system does not require complicated maintenance, nor is it heavily influenced by user characteristics. However, such system presents some drawbacks for firing heavy and medium weight cartridges needs a damper system between the barrel and the body; in addition, the recoil is felt greatly by the user.

"Gas Intake and Inertial" Operating System

The Applicant has recently developed an innovative "gas intake and inertial" operating system, described in the European patent EP-B1-1624275.

The operating system makes use of the extraction of a small quantity of gas from the barrel and of the firearm recoil, by means of a sliding obturator carriage, an obturator of the cartridge chamber and a spring positioned between the carriage and the obturator.

When firing lightweight cartridges, the cycle of opening and extraction and the rearming cycle, take place as a result of the gas and of the spring; when firing heavy cartridges, the cycles take place as a result of the spring alone. The system is self-regulating between said functions.

Such system is extremely advantageous and sums the advantages of the inertial system and gas intake system. However, it has some drawbacks: for example, it is a complex system and requires complicated maintenance and cleaning of the parts.

PURPOSE OF THE INVENTION

The purpose of the present invention is to make an operating system for individual firearms which overcomes the drawbacks of the prior art and which satisfies the aforementioned requirements.

Such purpose is achieved by a firearm made according to claim 1.

The characteristics and advantages of the individual firearm according to the present invention will be evident from the description given below, made by way of a non-limiting example, with reference to the appended drawings.

DESCRIPTION OF A PREFERRED EMBODIMENT

For clarity's sake, hereafter in the description explicit reference will be made to a rifle with a smooth bore barrel; however the invention is of a general kind and is applicable to all individual firearms, rifles or guns, for civilian use, sports or hunting, and military use, with automatic or semi-automatic functioning.

Figure 1:
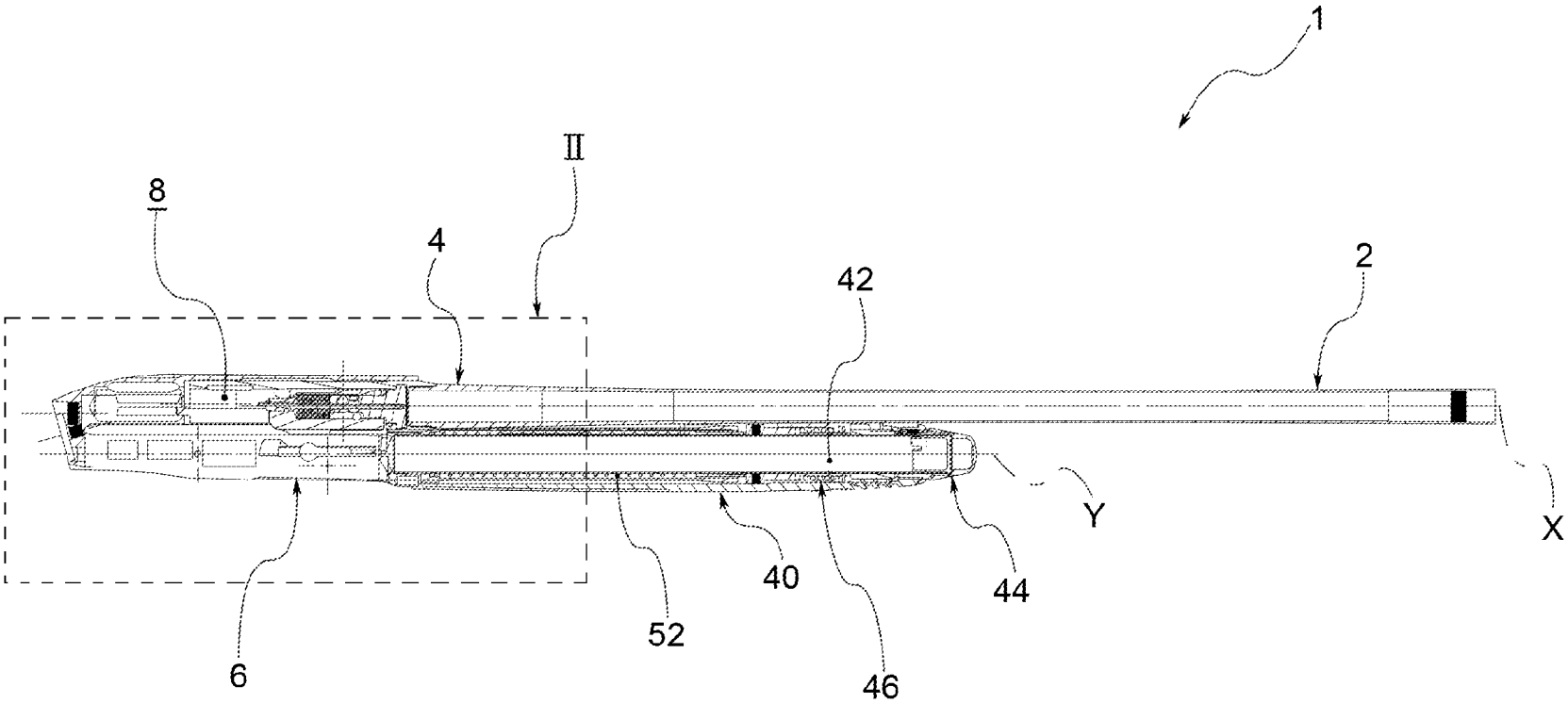
FIG. 1 shows an embodiment diagram of the functional group of a rifle with an operating system according to the invention, in a configuration of the firearm ready to fire with a bullet in the barrel.

With reference to FIG. 1, reference numeral 1 globally denotes an individual firearm, such as a rifle.

The rifle 1 comprises a barrel 2 having a main extension along a main axis X, between a free end, from which the shots fired come out, and an opposite proximal end 4.

The rifle 1 further comprises a body 6, provided with an operating compartment 8.

The barrel 2, at its proximal end 4, is engaged with the body 6, at the operating compartment 8.

The rifle 1 comprises an operating system suitable for performing a cycle of opening and expelling the case of the fired cartridge and a loading cycle of a new cartridge, automatically as a consequence of firing the previous cartridge.

The operating system comprises a breech 30 attached to the proximal end 4 of the barrel 2, made in the form of a hollow casing.

The breech 30 comprises breech tabs 30*a*, projecting internally, angularly distanced.

The operating system further comprises an obturator 10 which, in the configuration of the firearm ready to fire with a bullet in the barrel, is coupled in a releasable manner to the proximal end 4 of the barrel 2 so as to close a cartridge chamber 12 of the barrel, where the cartridge is situated before firing.

The obturator 10 comprises obturator tabs 10*a*, projecting externally and angularly distanced.

Figure 3:
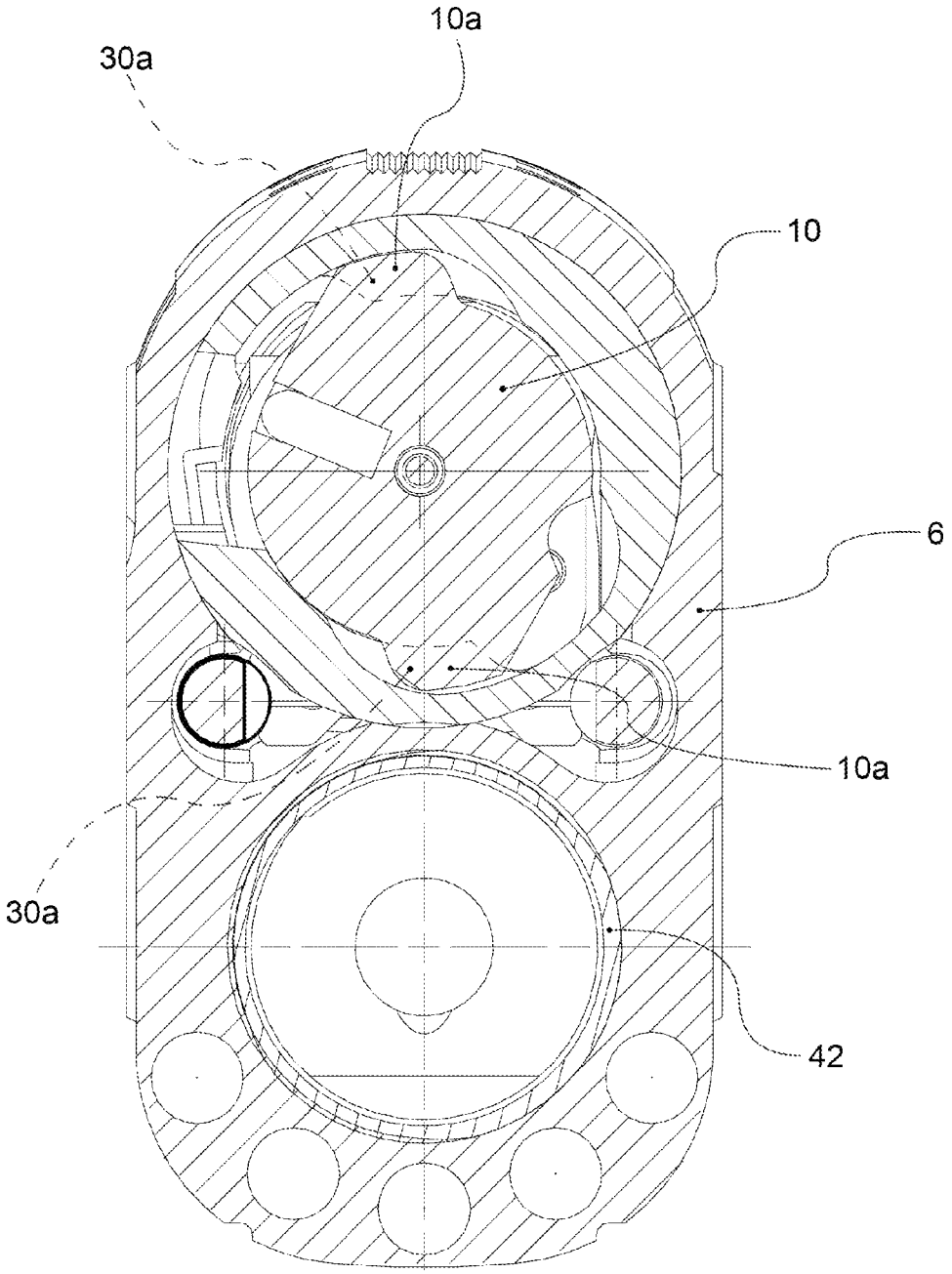
FIG. 3 shows a cross-section of the operating system in FIG. 2, along the cross-section line in FIG. 2.

In the configuration of the firearm ready to fire with a bullet in the barrel, the obturator tabs 10*a* are axially aligned with the breech tabs 30*a*, in such a way that the obturator is axially blocked, and therefore prevented from moving backwards by the barrel (FIG. 3).

In addition, the operating system comprises a carriage 14, sliding in the operating compartment 8 of the body 6, positioned facing[s] the obturator 10 at the front.

In particular, the carriage 14 comprises a cam engaged with the obturator 10, shaped so that the translation of the carriage makes the obturator rotate.

Furthermore, the operating system comprises at least one elastic element 16, for example formed of a plurality of Belleville type springs, positioned in a compressible manner between the carriage 14 and the obturator 10.

In particular, the elastic element 16 is on board the carriage 14.

According to a preferred embodiment, the operating system comprises a stem 20 joined to the carriage 14 and inserted in the obturator 10 so as to slide; said stem 20 axially traversing the elastic element 16.

The operating system further comprises an abutment 32 inside the operating compartment 8, suitable for structurally interfering with the breech 30 to limit the axial stroke inside said operating compartment, thereby limiting the axial stroke of the barrel.

For example, the abutment 32 is made in the operating compartment 8 of the body 6 by a projection of the wall itself which delimits said operating compartment.

The barrel 2 slides between a limit forward position (FIG. 2) in which the free stroke as far as the abutment 32 is maximised and defines a firing stroke C, and a limit rearward position, wherein the barrel 2, by means of the breech 30, abuts with the abutment 32.

Preferably, the firing stroke C is 3 to 5 millimeters; for example, the firing stroke is equal to 4 millimeters.

In addition, in the configuration of the firearm ready to fire with a bullet in the barrel (FIG. 2), the carriage 14 finds itself in an initial position in which it is a predefined initial distance from the obturator 10. Such distance is defined as the compression stroke D.

Preferably, the compression stroke D is 1 to 2 millimeters; for example, the compression stroke is equal to 1.5 millimeters.

In the embodiment shown, the compression stroke D is less than the firing stroke C.

Furthermore, the rifle 1 comprise a cartridge magazine 40, positioned under the barrel 2, which contains the cartridges to pass in succession into the cartridge chamber 12 for firing.

For example, the cartridge magazine 40 is attached at the proximal end to a projection of the body 6.

According to one embodiment, the magazine 40 comprises a container pipe 42 which extends axially along a container axis Y, parallel to and separate from the barrel axis X, closed at the front by a cap 44.

The operating system further comprises barrel recovery means suitable for influencing the barrel towards the forward limit position.

Said barrel recovery means are for example elastic means, for example comprising a barrel recovery spring 46 fitted coaxially to the container pipe 42 so as to be compressible.

Furthermore, the operating system comprises obturator carriage recovery means suitable for influencing the carriage 14 towards the initial position.

Said obturator carriage recovery means are for example elastic means, for example comprising a carriage recovery spring 52 fitted coaxially to the container pipe 42.

Figure 2:
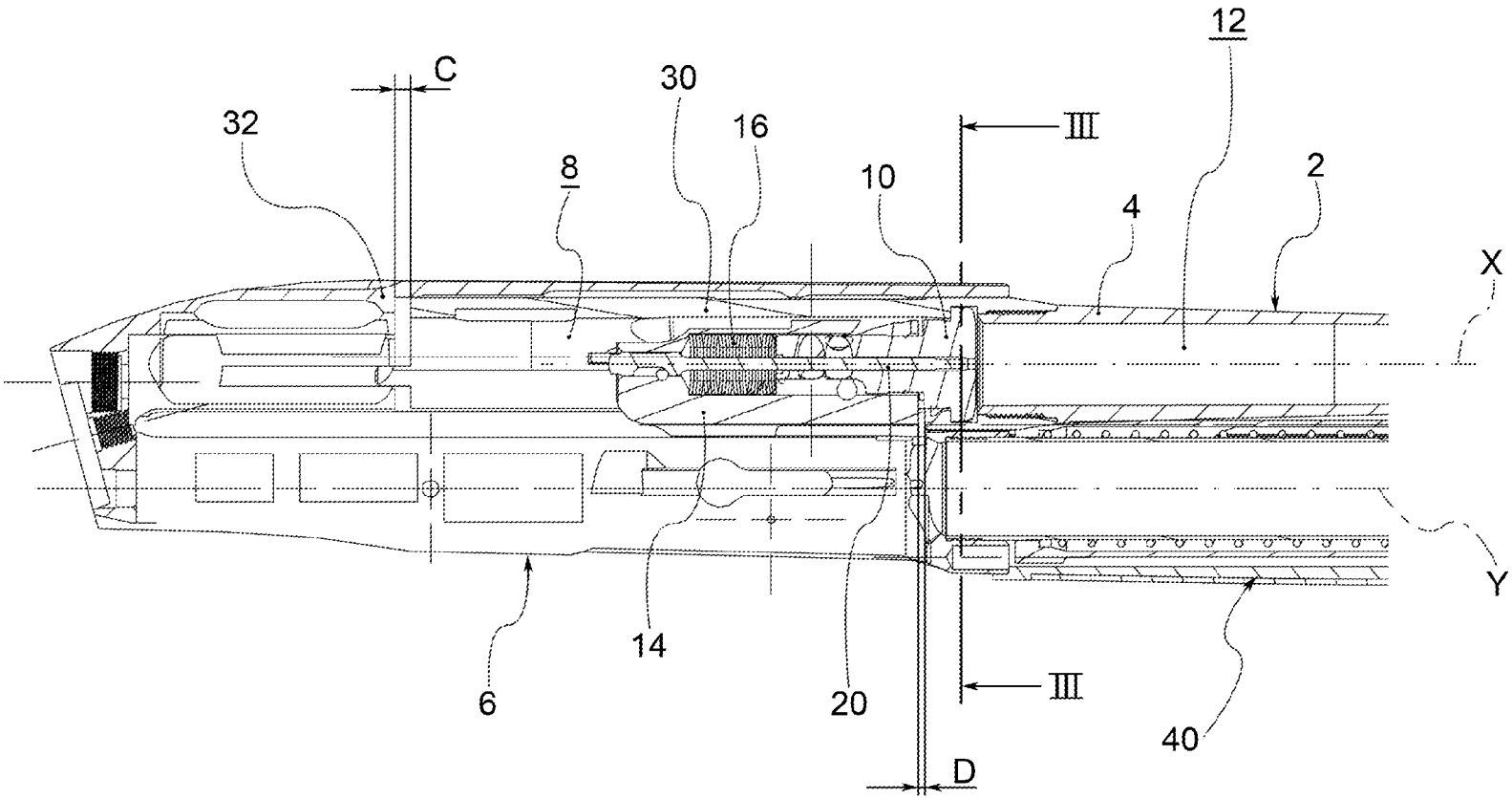
FIG. 2 shows an enlargement of the box II in FIG. 1.

In the configuration of the firearm ready to fire with a bullet in the barrel, the barrel is in the limit forward position and the obturator carriage is in the initial position (FIG. 2).

The cartridge is housed in the cartridge chamber 12.

During, firing, the explosion of the gunpowder contained in the cartridge takes place in the cartridge chamber 12, following which the shot is projected along the barrel 2, coming out of the distal end of it.

At the same time the barrel 2, which is slidable in relation to the body, moves backwards in relation to it.

As a result of the impulse given by the explosion, the barrel moves backwards while the carriage 14 by inertia remains still, inasmuch as sliding in the operating compartment 8. During firing, the obturator 10 moves towards, the carriage therefore, reducing or annulling the compression stroke D.

Figure 4:
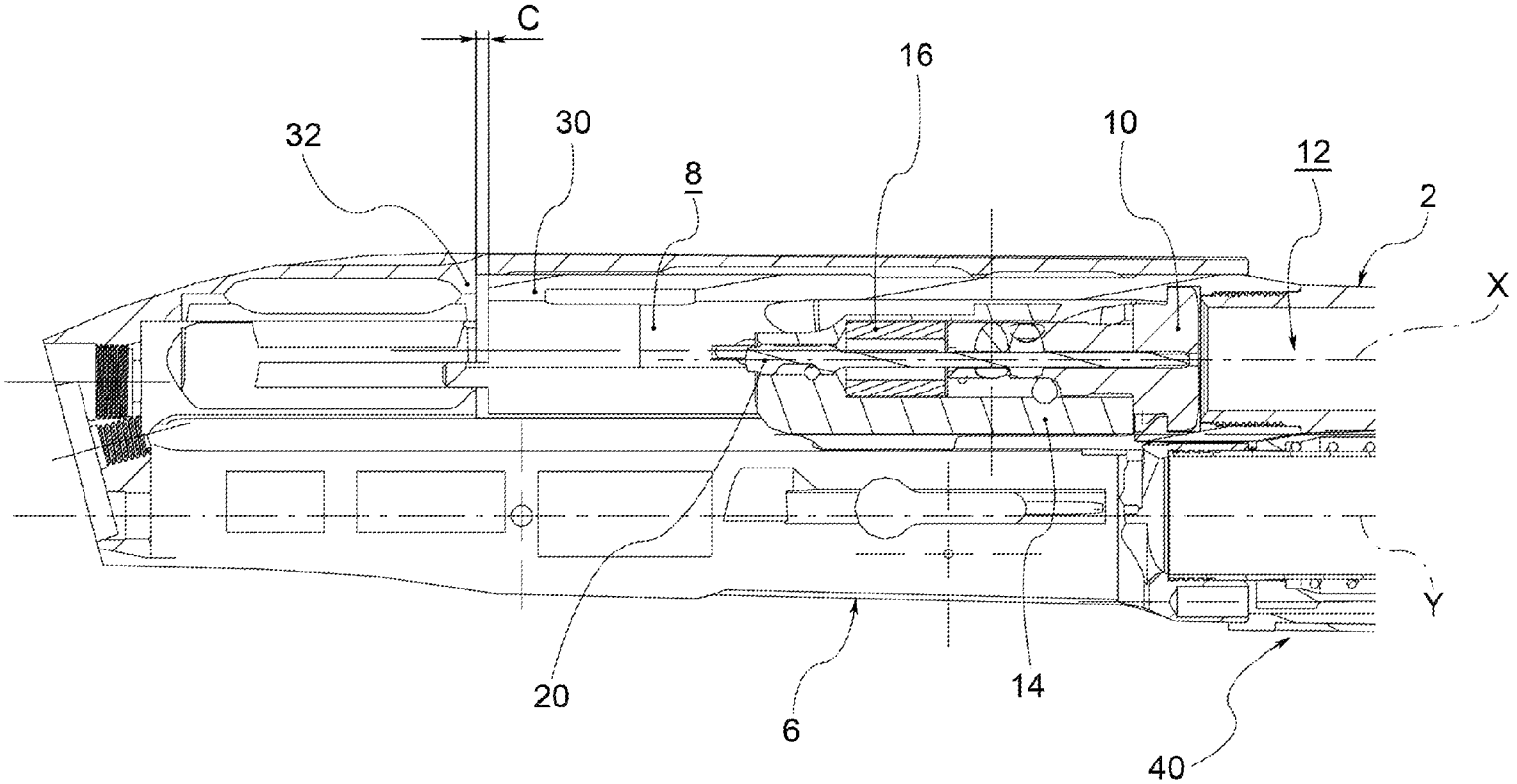
FIG. 4 shows the operating system in FIG. 1, in a configuration of maximum compression.

A compression configuration is thereby realised (FIG. 4). In fact, the approach of the obturator 10 towards the carriage 14 causes the compression of the elastic element 16.

In addition, the energy of the barrel 2 is such that its backward stroke continues, pushing the carriage 14 back too, by means of the obturator.

The breech 30 thus approaches the abutment 32 ending in abutment with it, which is relatively till, thereby annulling the firing stroke C.

Figure 5:
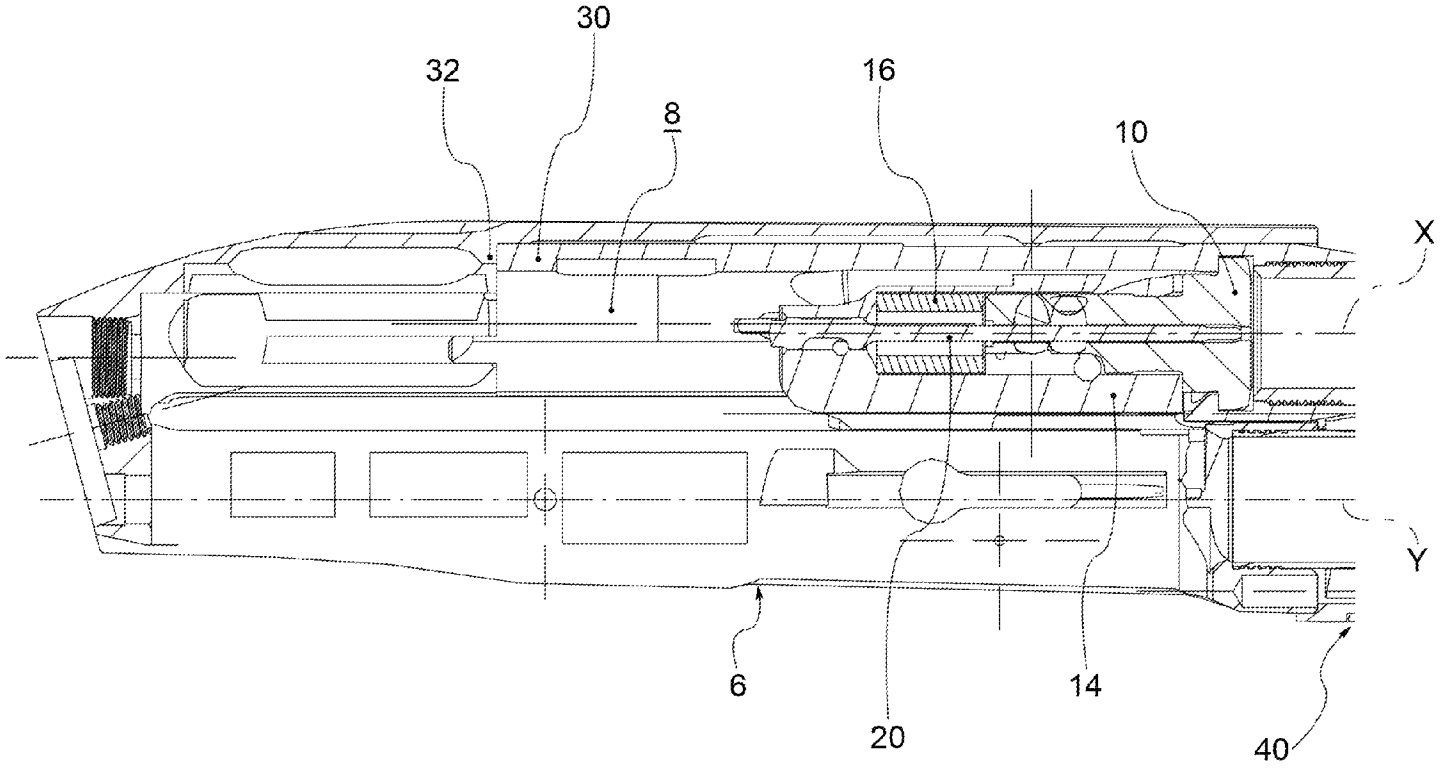
FIG. 5 shows the operating system in FIG. 1, in a firing configuration.

In such conditions a firing configuration (FIG. 5) is realised, wherein the barrel 2 is in abutment with the abutment 32, while the carriage 14 is free to move backwards on account of the thrust received by the barrel and the release of the elastic element 16.

By moving back the carriage acts on further rifle mechanisms, performing a cycle of opening and extracting the case of the fired cartridge and of loading the new cartridge.

Figure 7:
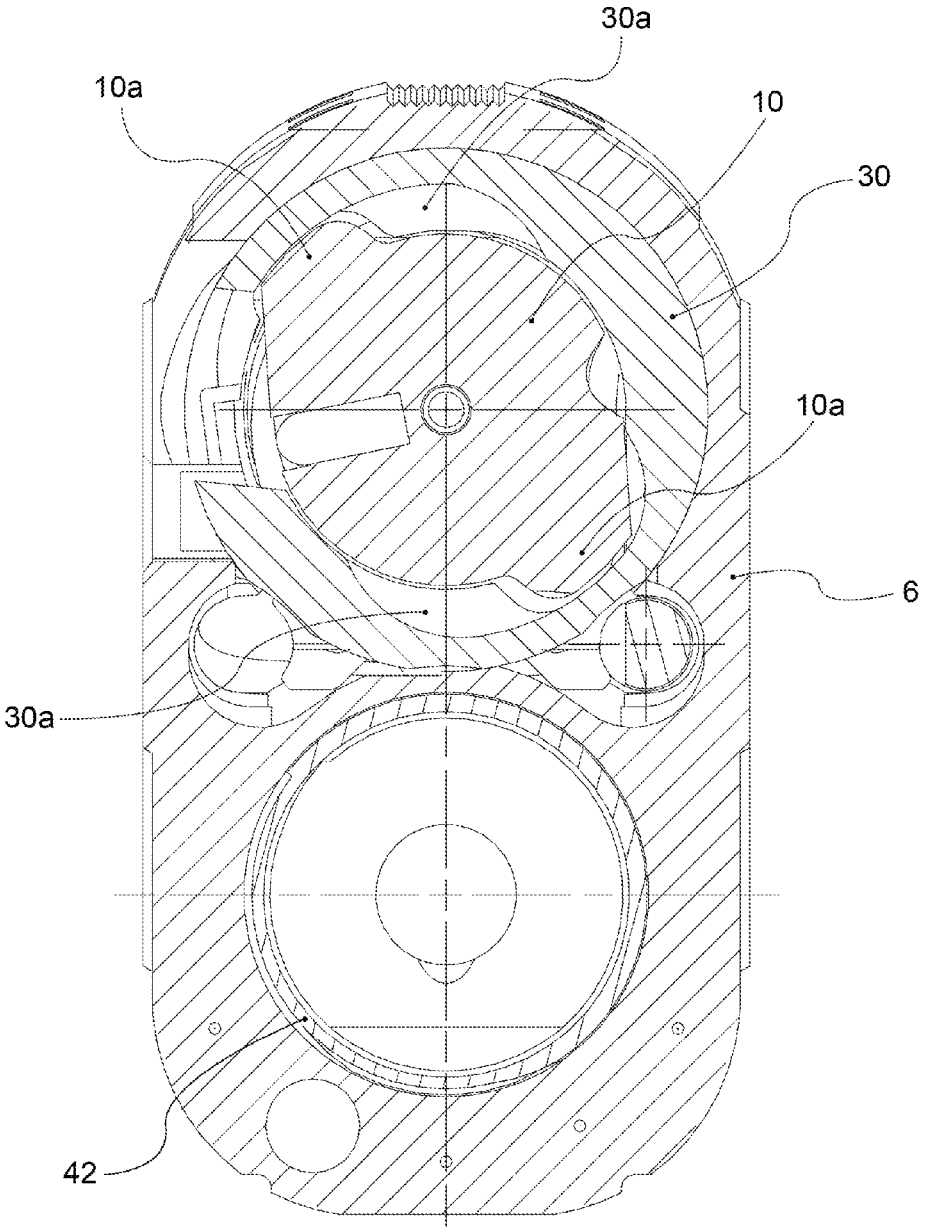
FIG. 7 shows a cross-section of the operating system in FIG. 6, along the cross-section line VII-VII in FIG. 6.

In particular, the carriage 14, moving backwards, causes by means of the cam, the rotation of the obturator 10, until said obturator disengages axially from the tabs of the breech 30 (FIG. 7).

Figure 6:
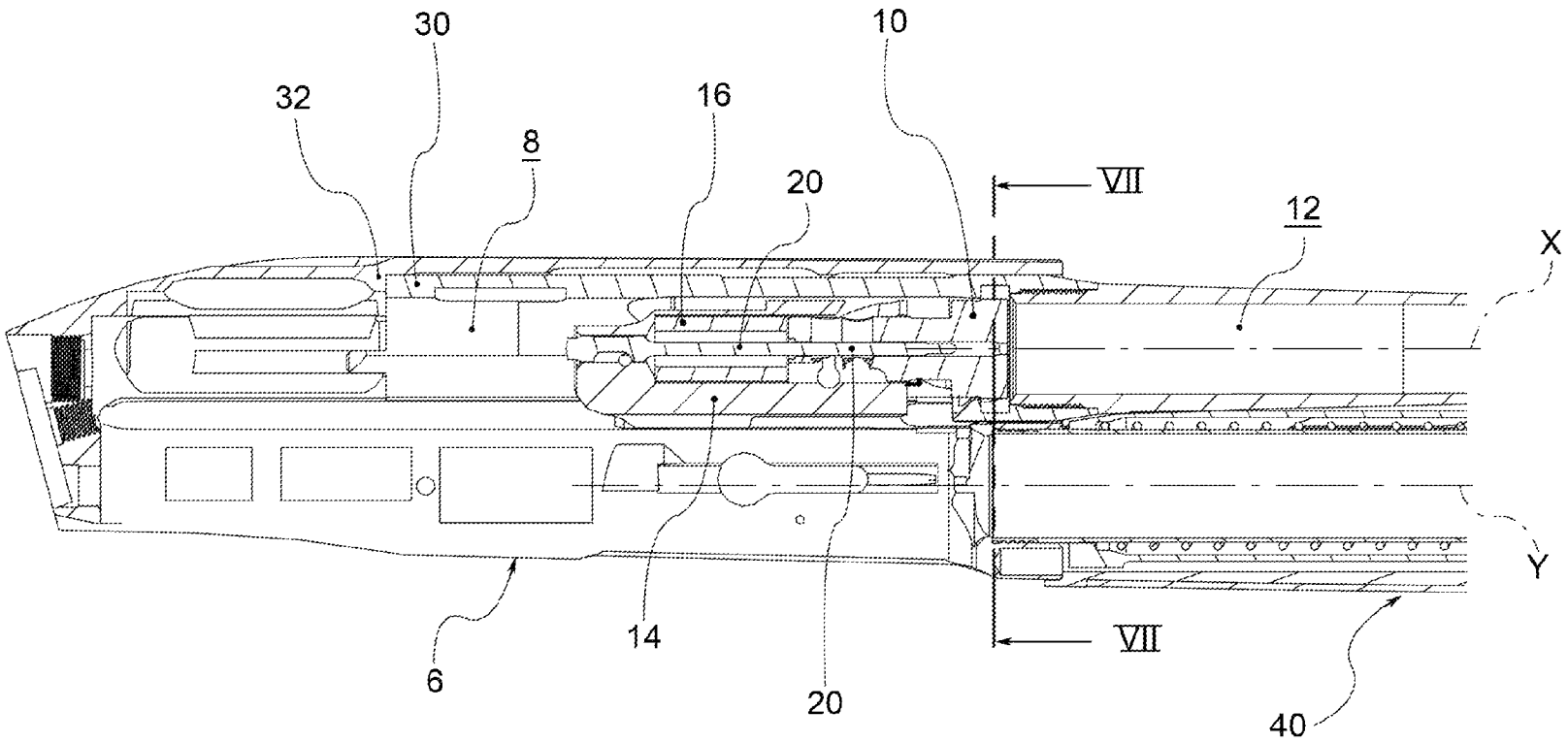
FIG. 6 shows the operating system in FIG. 1, in a released configuration.

In a released configuration (FIG. 6), the carriage still has the tendency to move backwards and the obturator is axially released, such as to be dragged backwards by the carriage 14.

Figure 8:
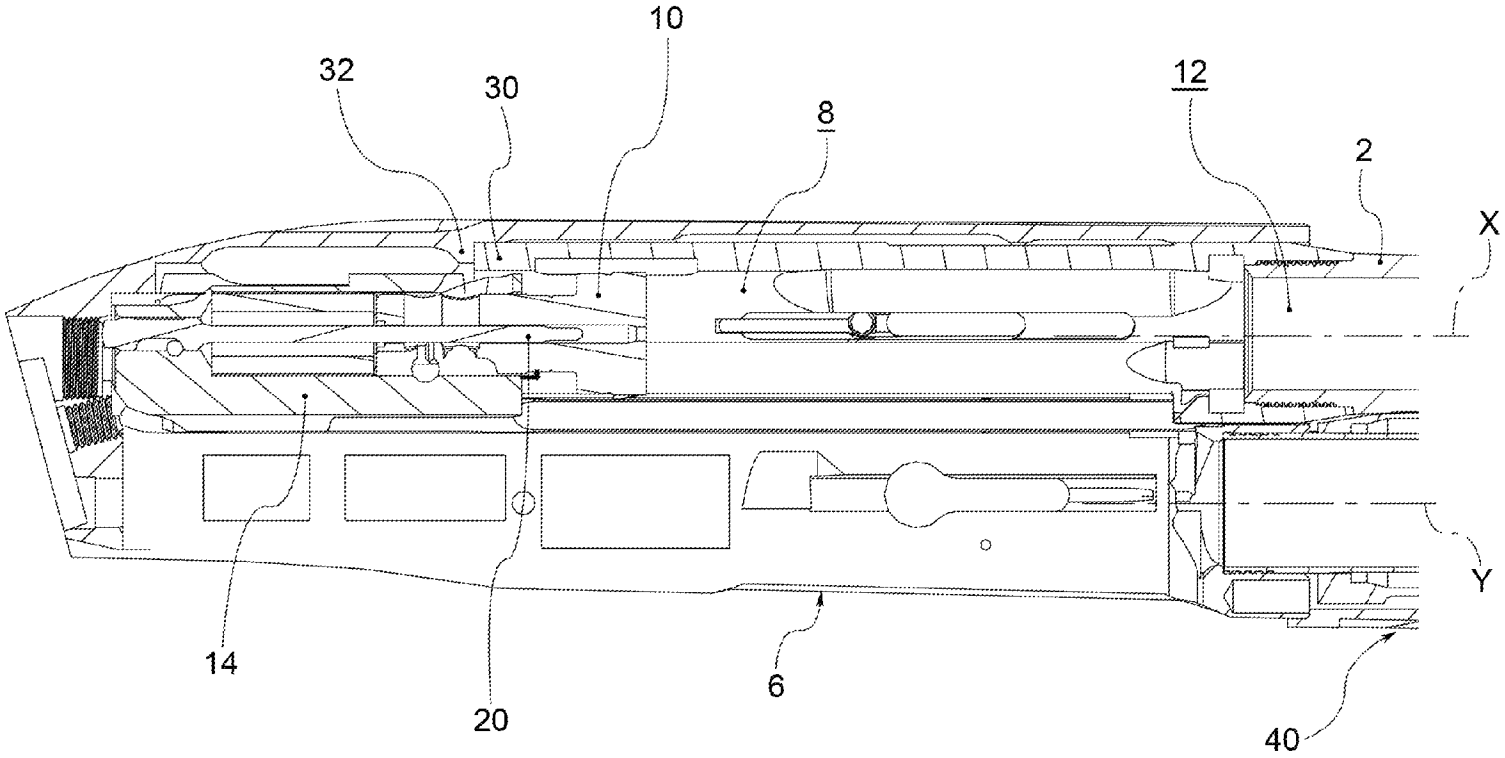
FIG. 8 shows the operating system in FIG. 1, in a limit stop configuration.

The carriage 14 lastly places itself in the limit rearward position of the limit stop configuration (FIG. 8).

The loading of the new cartridge then takes place.

From the position assumed in the firing configuration, the barrel is called back to the limit forward position by the action of the barrel recovery means, in particular of the barrel recovery spring 46.

From the limit rearward position, the carriage 14 is called back to the initial position by the carriage recovery means, in particular by the carriage recovery spring 42.

Innovatively, the operating system according to the present invention makes it possible to overcome the drawbacks of the prior art.

In fact, the firing stroke of the system according to the invention is generally less than the analogous firing stroke of the short barrel recoil systems of the prior art of equal efficacy; this is possible because the carriage can in part exploit the energy accumulated by the elastic element.

As a result, the operating system according to the invention is scaled on the basis of the lightest cartridges which are to be fired, but for the heavier cartridges, the barrel and carriage do not reach very high speeds, in that the firing stroke of the barrel is very short.

In addition, the impact between the barrel and the body is reduced, compared to the short recoil systems of the prior art, both as a result of the reduced firing stroke, spoken of, of the storage of part of the initial energy of the barrel in the elastic element and of the energy dissipated in the elastic element by friction.

As a result, the operating system according to the present invention has an optimal functioning both with lightweight cartridges and with cartridges of medium, heavy and very heavy weight.

In addition, advantageously the operating system according to the present invention is not affected by the physical characteristics of the user, in that the barrel is free to recoil.

Advantageously in addition, the operating system according to the present invention does not need a lightweight rifle to function optimally.

According to a further advantageous aspect, the firearm fitted with the operating system according to the present invention is able to assure a very long operating life, since the backward stroke speeds of the barrel and of the carriage are extremely limited.

Lastly, advantageously the operating system according to the present invention does not require complicated maintenance and is simple and economical to make.

Obviously, a person skilled in the art may make modifications to the operating system described above so as to satisfy contingent requirements. Such variations are also contained within the sphere of protection as defined by the following claims.

The invention claimed is:

1. An individual firearm, comprising:

a body containing an operating compartment, having an abutment;

a barrel extending mainly along a barrel axis, between a free distal end for the exit of the firing forces of the cartridges, and an opposite proximal end, containing a cartridge chamber, engaged with the body, said barrel sliding axially in relation to said body;

an automatic operating system for performing a cycle of opening, extracting the case of a fired cartridge and loading a new cartridge following the firing of the previous one, comprising:

a) a carriage, housed in the operating compartment of the body, sliding axially in said compartment;

b) an obturator associable with the proximal end of the barrel in a releasable manner, suitable to close the cartridge chamber;

c) an elastic element, compressible between the carriage and the obturator;

wherein in the configuration of the firearm when ready to fire with the bullet in the barrel, the obturator has a free compression stroke for the compression of the elastic element and the barrel has a free firing stroke between a limit forward position and the abutment of the operating compartment, wherein the free compression stroke is less than the free firing stroke;

the firearm characterized by the fact that the elastic element comprises a plurality of Belleville springs.

2. A firearm according to claim 1, wherein in a limit compression configuration, the obturator abuts with the carriage and the elastic element is compressed.

3. A firearm according to claim 1, wherein, in a firing configuration, the barrel is prevented from moving backwards by the abutment and said carriage is free to move backwards towards a rearward limit position.

4. A firearm according to claim 1, wherein the elastic element is on board the carriage.

5. A firearm according to claim 1, wherein the operating system comprises a stem joined in translation to the carriage, inserted so as to slide in the obturator and such as to traverse the elastic element.

6. A firearm according to claim 1, wherein the operating system comprises barrel recovery means suitable to influence the barrel towards the forward limit position and carriage recovery means suitable to influence the carriage towards the initial position.

7. A firearm according to claim 1, comprising a breech attached to the proximal end of the barrel, provided with breech tabs suitable to axially block the obturator.

8. A firearm according to claim 7, wherein the obturator is provided with obturator tabs axially disengageable from the breech by rotation.

9. A firearm according to claim 1, wherein the carriage comprises a cam engaged with the obturator, shaped so that the translation of the carriage makes the obturator rotate.

10. A rifle or carbine according to claim 1.

11. A gun according to claim 1.

* * * * *